US006474491B1

(12) United States Patent
Benoit-Gonin et al.

(10) Patent No.: US 6,474,491 B1
(45) Date of Patent: Nov. 5, 2002

(54) SCREW TOP WITH TEARAWAY STRIP

(75) Inventors: Claude Benoit-Gonin, Odenas; Jean-Yves Rognard, Marcy Sur Anse, both of (FR)

(73) Assignee: Crown Cork & Seal Technologies Corporation, Alsip, IL (US)

( * ) Notice: Subject to any disclaimer, the term of this patent is extended or adjusted under 35 U.S.C. 154(b) by 0 days.

(21) Appl. No.: 09/830,539

(22) PCT Filed: Oct. 28, 1999

(86) PCT No.: PCT/FR99/02642

§ 371 (c)(1),
(2), (4) Date: Jun. 28, 2001

(87) PCT Pub. No.: WO00/26108

PCT Pub. Date: May 11, 2000

(30) Foreign Application Priority Data

Oct. 29, 1998 (FR) ..... 98 13759

(51) Int. Cl.[7] ..... B65D 39/00
(52) U.S. Cl. ..... 215/252; 220/263
(58) Field of Search ..... 215/252, 258, 215/306; 220/263, 283, 810, 836, 837, 843, 845, 847

(56) References Cited

U.S. PATENT DOCUMENTS 5,215,204 A * 6/1993 Beck et al. ..... 215/252
6,158,197 A * 12/2000 Mogard et al. ..... 53/410
6,299,005 B1 * 10/2001 Higgins ..... 215/237

* cited by examiner

*Primary Examiner*—Lee Young
*Assistant Examiner*—Lien Ngo
(74) *Attorney, Agent, or Firm*—Cantor Colburn LLP

(57) ABSTRACT

A cap is provided including a ring held axially on that part of the container which delimits the opening of this container, and two arms in the form of an arc of a circle, each of which is connected to the cap on the one hand, by means of a film hinge and parts that are able to fold, and to the ring on the other hand. These arms allow the cap to be tilted outwards with respect to the container so as to be released from the opening of the container.

According to the invention, the cap includes means shaped so as to bear, at the time of the said tilting, against the container and to exert, via this bearing, a pulling on the said arms, this pulling being non-existent or minimal in the positions of engagement of the cap over the opening of the container and of complete release of this cap beyond this opening, but being maximal in the intermediate position of the cap between these two positions.

18 Claims, 3 Drawing Sheets

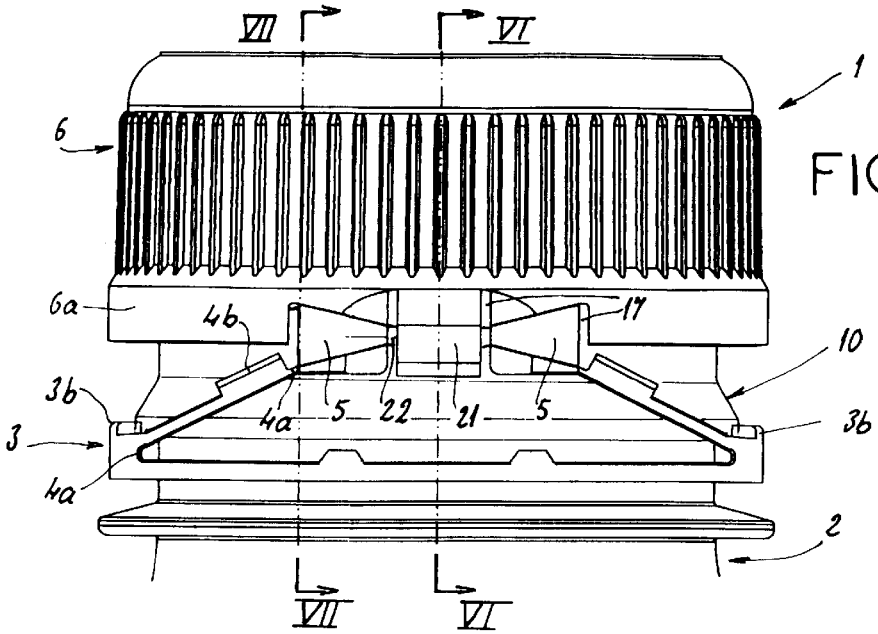
FIG 4
FIG 3
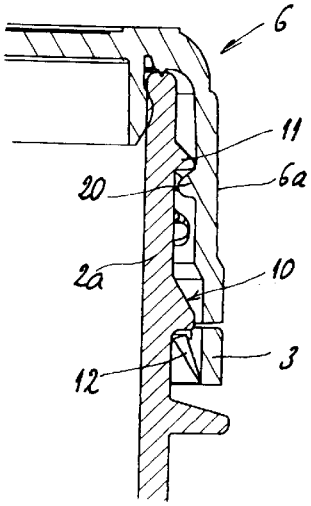
FIG 5
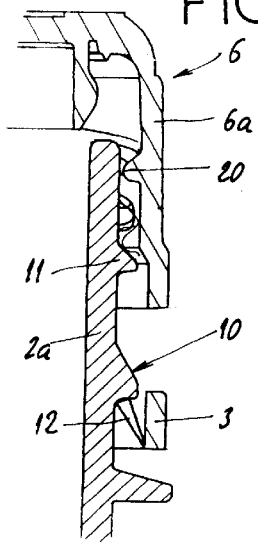
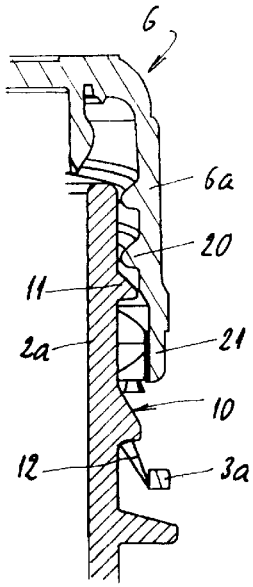
FIG 6
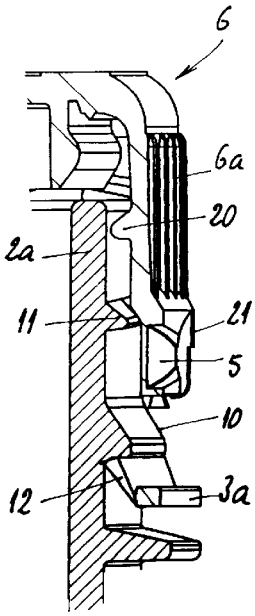
FIG 7

SCREW TOP WITH TEARAWAY STRIP

TECHNICAL FIELD

The present invention relates to a capping device comprising means for preventing the complete separation of a container and of the cap closing this container.

BACKGROUND OF THE INVENTION

It is known from U.S. Pat. No. 5,215,204 to produce a capping device comprising

- a cap, the lateral skirt of which is equipped with means for its engagement with a container, it being possible for this cap, in one position, to be placed over the opening of the container so as to close this container and, in another position, to be released from this opening so as to allow access to the inside of the container;
- a ring engaged on that part of the container which delimits the said opening and held axially on it; and
- two arms in the form of an arc of a circle, each one of which is connected to the cap on the one hand, by means of a film hinge and parts that are able to fold, and to the ring on the other hand, the arms being connected to the ring at locations which are angularly distant with respect to the film hinge; the said parts that are able to fold allow the pivoting of the arms between a folded position, in which these arms are placed close to the ring and in which the cap is axially close to the ring, and an unfolded position, in which these arms are pivoted with respect to the film hinge and to the ring; in this same unfolded position, the arms, by means of their length, allow the cap to be brought into a position which is axially remote from the ring, this position being sufficient to make it possible to release the said means for engaging the cap with the container and to tilt the said cap outwards with respect to this container so as to bring this cap into the position in which it is released from the opening of the container.

The device according to this document has the drawback that the cap tends to be placed normally above the opening of the container, given the elastic return of the synthetic material which constitutes this device. This position of the cap significantly impedes the flow of the product contained in the container and forces the user to hold the cap in a tilted position during this flow, Moreover, the operation of this device is not very attractive and the structure of this device could be improved with a view to optimum

SUMMARY OF THE INVENTION

The object of the invention is to provide a capping device which remedies all these drawbacks. It must be possible for this device to be placed on any type of container, but, in particular, to be intended for commonly used, mass-produced containers, such as mineral-water bottles, it having to be possible for the operation of placing the device to be carried out in a mechanized manner and at a high rate.

A further object of the invention is to provide a capping device which is easy to handle as regards the opening and closing of the container, providing reliable retention of the cap on the container, which cap is inexpensive to manufacture and easy to place on the container and which has an attractive visual appearance.

The device to which it relates is of the type set forth hereinabove, the preamble of claim 1 corresponding to the teaching of the aforesaid prior patent.

According to the invention, the cap comprises means shaped so as to bear, during the said tilting, against the container and in order to exert, by means of this bearing, a pulling on the said arms, this pulling being non-existent or minimal in the positions of engagement of the cap over the opening of the container and of total release of this cap from this opening, but being maximal in the intermediate position of the cap between these two positions.

The aforesaid means, together with the possibility of elastic expansion made possible by the arms, thus make it possible to create a hard point midway through the tilting of the cap, so that the device is of the "flip-top" type.

This flip-top characteristic makes it possible perfectly to keep the cap in its tilted position, against the elastic return of the synthetic material constituting the device; the user thus does not have to hold the cap in the tilted position during flow of the product contained in the container.

Moreover, this flip-top property makes the device appealing to handle.

The said means may consist of a tongue projecting axially from the skirt of the cap, close to the said film hinge.

The edge of the tongue bearing against the container is advantageously rounded, to promote the rolling of this tongue along the wall of the container.

The means allowing sufficient deformation of the device to allow pivoting of the arms between the said folded and unfolded positions may consist of one or more of the following means:

- a material constituting the capping device, chosen from materials, particularly polyethylene or polypropylene, which offer a possibility of elastic expansion;
- a clearance between the ring and the container in order to allow, through the deformation of this ring, the relative displacement, in the circumferential direction, of the ends of the arms connected to this ring;
- at least one slit or one notch made at the level of the film hinge to allow the relative displacement, in the circumferential direction, of the ends of the arms connected to this film hinge;
- arms included, in the folded position, in the thickness of the ring and separated by recesses made in this thickness so that the ring has, plumb with the arms, a height which is less than the height it has in the other locations on its circumference, this smaller height promoting its deformation during movement of the arms.

Preferably, the ring and/or at least one arm is, before the first opening of the container, connected to the cap and/or to the film hinge by breakable bridges which are intended to be broken at the time of this first opening.

These bridges not only constitute evidence that the container has not been tampered with but also make it possible to confer perfect structural homogeneity on the device.

Advantageously, the said means for the engagement of the cap with the container are of the screw type and the ring is fitted free in rotation on the container.

Unscrewing of the cap gives rise to the aforesaid movement of the arms, and, as the case may be, the rupture of the bridges constituting the evidence that the container has not been tampered with.

According to a preferred embodiment of the invention, the cap comprises two film hinges made on either side of a tongue as aforesaid, an arm being connected to each of these film hinges.

These two film hinges located on either side of the said tongue allow stable movement of the arms and a stable tilting of the cap with respect to the container.

In order to be understood properly, the invention is described again below with reference to the appended diagrammatic drawing which represents, by way of non-limiting example, a preferred embodiment of the capping device to which it relates.

FIG. 3 is a partial view thereof, in section through the plane of the page in FIG. 2

FIG. 4 is a side view thereof, similar to FIG. 2, during opening of the container FIG. 5 is a partial view thereof, in section through the plane of the page in FIG. 4

FIGS. 6 and 7 are partial views thereof, in section along the lines VI—VI and VII—VII of FIG. 4, respectively.

DETAILED DESCRIPTION OF THE PREFERRED EMBODIMENT

Figure 1:
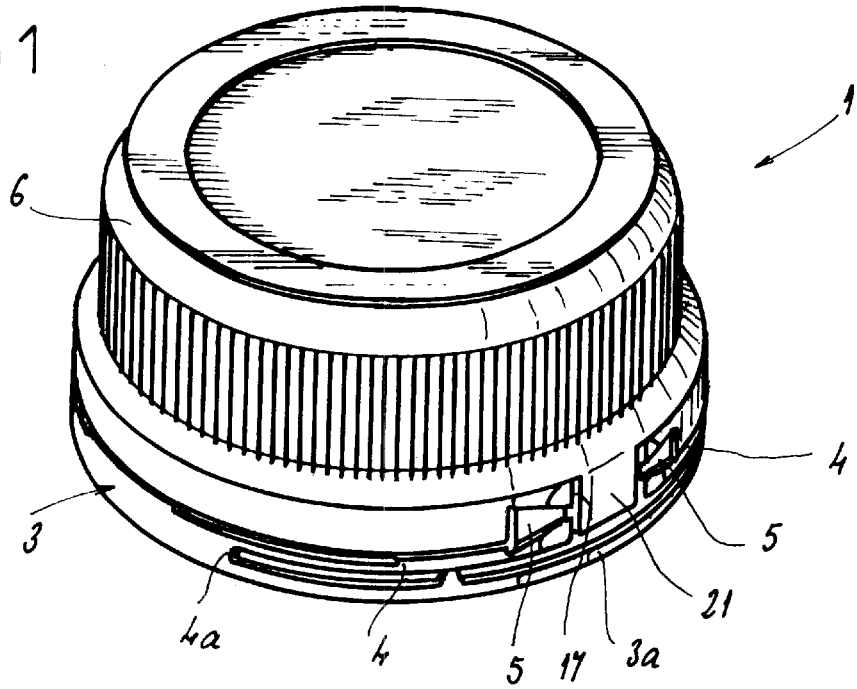
FIG. 1 is a perspective view thereof, prior to fitting on a container

The figures show a capping device 1 of a container 2, comprising a ring 3, two arms 4, two film hinges 5 and a cap 6, the entire assembly being moulded in a single piece from synthetic material, such as polyethylene.

It can be seen, in FIGS. 3 to 5 and 8, in particular, that the neck 2*a* of the container 2 comprises a collar 10 delimiting an upper conical bearing surface, enlarging in the direction towards the bottom of the container 2, and a shoulder in its lower part, as a consequence of the said bearing surface.

This neck 2*a* also comprises helical ribs 11 forming a screw thread to allow the opening and closing of the container 2 by screwing or unscrewing of the cap 6.

The ring 3 comprises inner tongues 12 connected to its lower part by thinner portions and projecting radially towards the inside. These tongues 12 are intended, as FIGS. 3, 5, 6 and 7 show, to slide against the said bearing surface during the first placing of the device 1 on the neck 2*a* until the lower end of this bearing surface is exceeded, then to lock, by means of elastic return, behind the said shoulder. The ring 3 is thus immobilized axially on the neck 2*a* whilst still being able to turn with respect to the latter.

There is a slight clearance between the ring 3 and the neck 2*a*.

The arms 4 are, as FIGS. 1 to 4 and 8 show more particularly, included in the thickness of the ring 3 and separated by recesses made in this thickness. The result of this is that the ring 3 has, plumb with these arms 4, a portion 3*a* with a height that is smaller than the height it has in the other locations on its circumference. This smaller height, combined with the aforesaid clearance, allows a certain deformation of the ring 3 in the circumferential direction, as will be described below.

The ring 3 also comprises portions 3*b* of increased thickness or studs 3*c* for supporting the cap 6 and the arms 4 in the event of significant loads exerted on the cap.

Each arm 4 has the shape of an arc of a circle and is connected, via parts 4*a* with a thickness which is sufficiently reduced so as to be able to fold, to the cap 6 on the one hand, at the level of one of the film hinges 5, and to the ring 3 on the other hand.

Each arm 4 is connected to the ring 3 at a location which is angularly distant with respect to the film hinge 5 to which it is connected, the angle formed by this location and this film hinge being, in the example shown, of the order of 45 to 50°.

The arms 4 also have portions 4*b* of increased thickness in order, also, to form zones for supporting the cap 6 in the event of a load.

These portions 4*b* are connected to the film hinges 5, by means of breakable bridges 15, which are intended to be broken at the time of the first opening of the container 2.

The film hinges 5 consist of walls of reduced thickness, of triangular shape, connected to the wall of the cap 6 on the one hand and to the arms 4 on the other hand.

Figure 8:
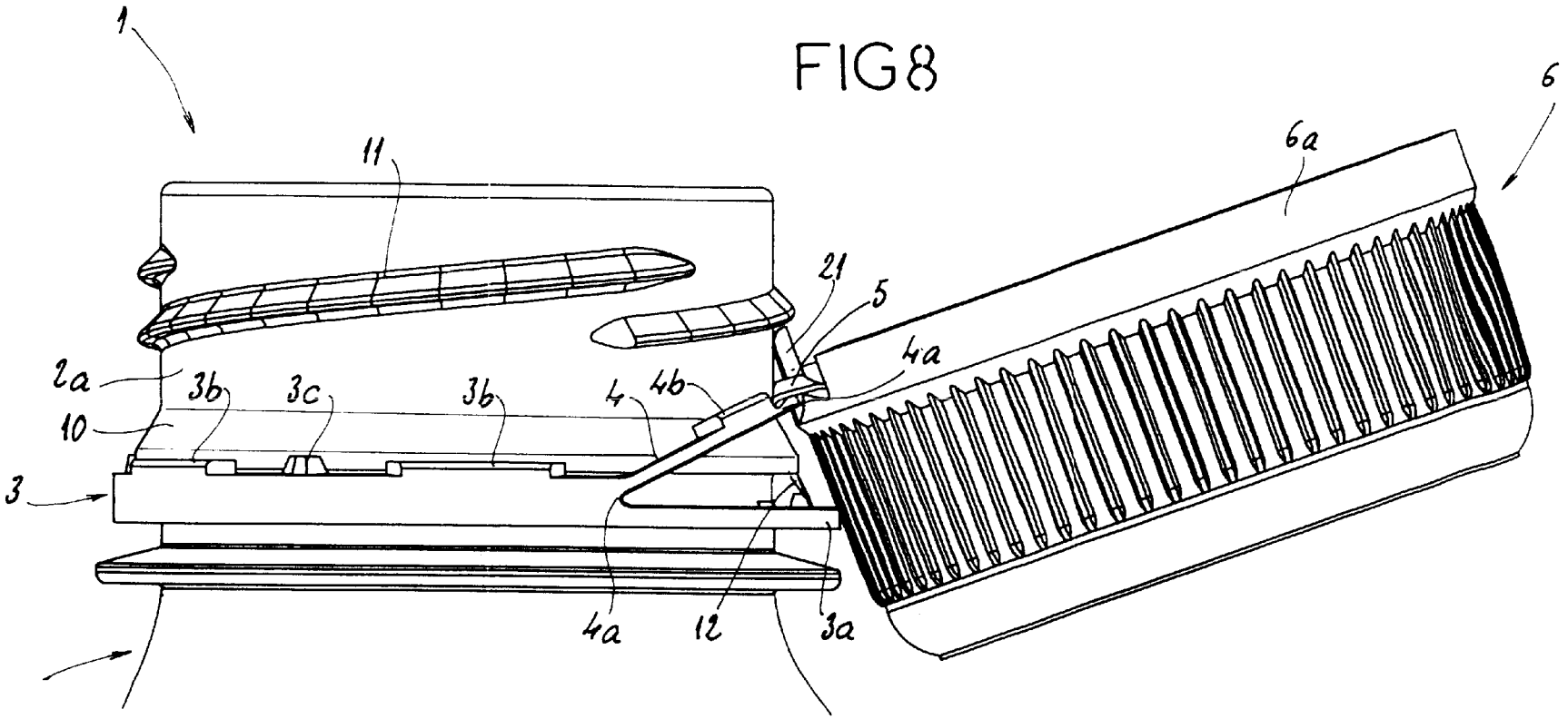
FIG. 8 is a side view thereof, in a direction perpendicular to the views of FIGS. 2 and 4, in the position of full opening of the container.

The flexibility which allows the tilting of the cap 6 shown in FIG. 8 is obtained by means of this triangular shape and by the arrangement in the cap 6 of webs of material 16 having a limited thickness, as well as slits 17.

The cap 6 comprises a skirt 6*a* provided with helical ribs 20 which compliment those of the neck 2*a*.

It also comprises a tongue 21 projecting axially from this skirt 6*a*, between the two film hinges 5.

Figure 2:
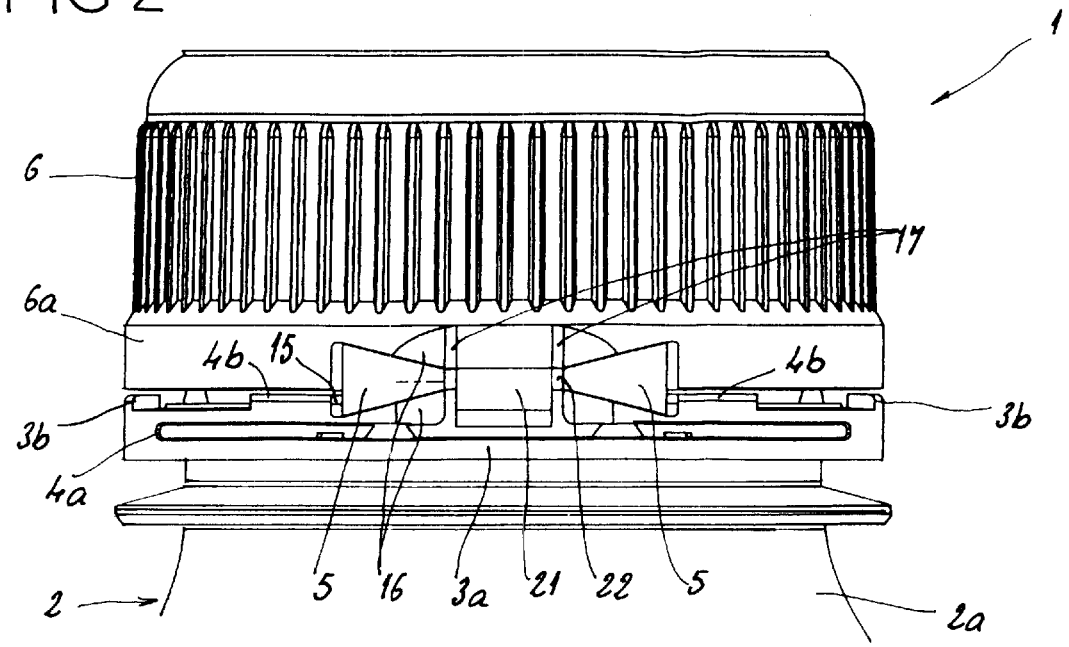
FIG. 2 is a side view thereof, after fitting on the container and prior to first opening of this container

It can be seen, particularly in FIGS. 2 and 4, that these latter are symmetrical with respect to the median axis of the tongue 21 and that each of them has, from the corresponding lateral edge of the tongue 21, two oblique sides which diverge, then end, on the side opposite this edge of the tongue 21, in a side parallel to this same edge.

This tongue 21 is connected to the film hinges 5 by two bridges of material 22, allowing the cohesion of the assembly and describing a flexing line. The tongue 21 also comprises a rounded outer lower edge intended to bear and to roll against the wall of the neck 2*a*.

This tongue 21 has a length such that, during tilting of the cap 6 shown in FIG. 8, it bears against the container 2 and exerts, via this bearing, a pulling on the arms 4. This pulling is non-existent in the positions of engagement of the cap 6 over the opening of the container 2 (FIG. 4) and of full release of this cap 6 beyond this opening (FIG. 8), but is maximal, the tongue 21 then being flexed, in the intermediate position of the cap 6 between these two positions.

In practice, the device 1 is placed on the container 2 by simple screwing until locking of the tongues 12 beyond the shoulder of the collar 10. During the first unscrewing, the cap 6 progressively leaves its position which is axially close to the ring 3 (FIG. 2) until it reaches the position which is axially remote from this ring 3 (FIG. 4), in which the helical ribs 11, 20 of the container 2 and of the cap 6 are out of engagement. The bridges 15 rupture during this movement and the arms 4 pass from their folded position shown in FIG. 2 to the unfolded position shown in FIGS. 4 and 8, by pivoting about the parts 4*a*.

This pivoting of the arms 4 is made possible by the elastic expandability of the material constituting the device 1, by the deformation of the ring 3 made possible by virtue of the clearance which exists between the neck 2*a* and this ring 3, by the thinner portion 3*a* of the ring 3 and by the slits 17 which exist between the film hinges 5 and the cap 6 and between the film hinges 5 and the tongue 21.

Once in the position shown in FIG. 4, the cap 6 may be tilted as far as the position shown in FIG. 8, by virtue of the film hinges 5 and by rolling and deformation of the tongue 21 against the neck 2*a*.

This tongue 21 allows the cap 6 to be of the "flip-top" type between the positions shown in FIGS. 4 and 8, which makes the device 1 appealing to handle.

The invention thus provides a capping device which makes it possible to remedy the drawbacks of similar devices from the prior art, since it may be placed on any type of container, particularly commonly used, mass-produced containers, such as mineral-water bottles, it being possible for the operation of placing the device to be carried out in a mechanized manner and at a high rate. This device is, in addition, also easy to handle as regards opening and closing the container, ensures reliable retention of the cap on the container, is inexpensive to manufacture and easy to place on the container and has an attractive visual appearance.

What is claimed is:

1. Capping device comprising a cap, a lateral skirt of which is equipped with a means for engagement with a container, it being possible for the cap, in one position, to be placed over an opening of the container so as to close the container and, in another position, to be released from the opening so as to allow access to the inside of the container;

a ring engaged on the container to delimit said opening and held axially thereon; and two arms in the form of an arc of a circle, each one of which is connected to the cap by a film hinge and a foldable means, and to the ring, the arms being connected to the ring at locations which are angularly distant with respect to the film hinge; said foldable means allows pivoting of the arms between a folded position, in which the arms are placed close to the ring and in which the cap is axially close to the ring, and an unfolded position, in which the arms are pivoted with respect to the film hinge and to the ring and allow the cap to be brought into a position which is axially remote from the ring, this position being sufficient to make it possible to release said means for engaging the cap with the container and to tilt said cap outwards with respect to the container so as to bring the cap into the position in which it is released from the opening of the container;

wherein the cap comprises a bearing means which, during said tilting, bears against the container and exerts, a pulling on the arms, the pulling being minimal in the positions of engagement of the cap over the opening of the container and of total release of the cap from the opening, but being maximal in the intermediate position of the cap between these two positions.

2. Device according to claim 1, wherein said bearing means includes a tongue projecting axially from the skirt of the cap, close to said film hinge.

3. Device according to claim 2, wherein an edge of the tongue bearing against the container is rounded.

4. Device according to claim 1 wherein the foldable means includes at least one of:

a material constituting the capping device which offers a possibility of elastic expansion;

a clearance between the ring and the container in order to allow, through the deformation of the ring, the relative displacement, in a circumferential direction, of ends of the arms connected to the ring;

at least one slit or one notch made at the level of the film hinge to allow the relative displacement, in the circumferential direction, of the ends of the arms connected to the film hinge; and the arms included, in the folded position, in a thickness of the ring and separated by recesses made in the thickness so that the ring has, plumb with the arms, a height which is less than a height it has in other locations on its circumference.

5. Device according to claim 1, wherein the ring is, before opening the container, connected to the cap by breakable bridges which are intended to be broken at the time of opening the container.

6. Device according claim 1, wherein said means for the engagement of the cap with the container is of a screw type and the ring is fitted free in rotation on the container.

7. Device according to claim 2, wherein the cap comprises two film hinges made on either side of a tongue, each of the arms being connected to one of these film hinges.

8. Device according to claim 7, wherein the film hinges have a triangular shape and are symmetrical with respect to a median axis of the tongue; each of the film hinges has, from a corresponding lateral edge of the tongue, two oblique sides which diverge, then end, on a side opposite this edge of the tongue, in a side parallel to the same edge.

9. Device according to claim 8, wherein the tongue is connected to the film hinges by two bridges of material.

10. Device according to claim 4, wherein said material is polyethylene or polypropylene.

11. Device according to claim 1, wherein the ring is, before opening the container, connected to the film hinge by breakable bridges which are intended to be broken at the time of opening the container.

12. Device according to claim 1, wherein at least one arm is, before opening the container, connected to the cap by breakable bridges which are intended to be broken at the time of opening the container.

13. Device according to claim 1, wherein at least one arm is, before opening the container, connected to the film hinge by breakable bridges which are intended to be broken at the time of opening the container.

14. Device according to claim 1, wherein the ring is, before opening the container, connected to the ring and to the film hinge by breakable bridges which are intended to be broken at the time of opening the container.

15. Device according to claim 1, wherein at least one arm is, before opening the container, connected to the cap and to the film hinge by breakable bridges which are intended to be broken at the time of opening the container.

16. Device according to claim 1, wherein the ring and at least one arm are, before opening the container, connected to the cap by breakable bridges which are intended to be broken at the time of opening the container.

17. Device according to claim 1, wherein the ring and at least one arm are, before opening the container, connected to the film hinge by breakable bridges which are intended to be broken at the time of opening the container.

18. Device according to claim 1, wherein the ring and at least one arm are, before opening the container, connected to the cap and to the film hinge by breakable bridges which are intended to be broken at the time of opening the container.

* * * * *